US007918746B2

(12) United States Patent
Kumamoto

(10) Patent No.: US 7,918,746 B2
(45) Date of Patent: Apr. 5, 2011

(54) GOLF CLUB SHAFT

(75) Inventor: Tomio Kumamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 12/216,763

(22) Filed: Jul. 10, 2008

(65) Prior Publication Data

US 2009/0069109 A1 Mar. 12, 2009

(30) Foreign Application Priority Data

Sep. 12, 2007 (JP) ..... 2007-236779

(51) Int. Cl.
*A63B 53/10* (2006.01)

(52) U.S. Cl. ..... 473/319

(58) Field of Classification Search ..... 473/318–319
See application file for complete search history.

(56) References Cited

U.S. PATENT DOCUMENTS

2002/0052249 A1* 5/2002 Oyama ..... 473/319
2002/0082112 A1* 6/2002 Unosawa et al. ..... 473/318
2003/0022728 A1 1/2003 Hasegawa

FOREIGN PATENT DOCUMENTS

JP 09234256 A * 9/1997
JP 2003-24489 A 1/2003

* cited by examiner

*Primary Examiner* — Stephen L. Blau
(74) *Attorney, Agent, or Firm* — Birch, Stewart, Kolasch & Birch, LLP

(57) ABSTRACT

A shaft 6 is formed by a prepreg sheet. The sheet of the shaft 6 includes full length sheets (a2), (a3), (a8) and (a11) provided wholly in a longitudinal direction of the shaft, and partial sheets (a1), (a4), (a5), (a6), (a7), (a9), (a10) and (a12) provided partially in the longitudinal direction of the shaft. The number of the full length sheets is equal to or greater than two. The number of the partial sheets is equal to or greater than four. Each of the partial sheets has an end. When four sections obtained by dividing the shaft into four equal parts in the longitudinal direction are set to be first, second, third and fourth sections from a tip end side in order, the total number of ends positioned in the first section is represented as (N1), the total number of ends positioned in the second section is represented as (N2), the total number of ends positioned in the third section is represented as (N3), and the total number of ends positioned in the fourth section is represented as (N4), all of (N1), (N2), (N3) and (N4) are equal to or greater than one.

8 Claims, 10 Drawing Sheets

GOLF CLUB SHAFT

This application claims priority on Patent Application No. 2007-236779 filed in JAPAN on Sep. 12, 2007, the entire contents of which are hereby incorporated by reference.

BACKGROUND OF THE INVENTION

1. Field of the Invention

The present invention relates to a golf club shaft.

2. Description of the Related Art

As a golf club shaft, so-called steel and carbon shafts have been known. The carbon shaft is constituted by CFRP (carbon fiber reinforced plastic).

Most of the carbon shafts are manufactured by a so-called sheet winding process. In the sheet winding process, a prepreg sheet including a fiber and a matrix resin is used. In the process, a sheet formed of prepreg is wound around a metallic core member and the matrix resin is then cured by heating, and the core member is pulled out after the curing. By the process, there is formed a shaft which is obtained by winding and curing the prepreg sheet.

Japanese Laid-Open Patent Publication No. 2003-24489 has disclosed a carbon shaft in which a straight layer, an angle layer and a hoop layer are provided and a tensile modulus of elasticity of a fiber or the like is specified. Referring to the shaft, it is possible to achieve a lightweight property and a high strength. US Patent Application No. US2003/022728 A1 corresponds to the Japanese Laid-Open Patent Publication No. 2003-24489.

SUMMARY OF THE INVENTION

In a carbon shaft, a partial layer (a partial reinforced layer) can be provided partially in a longitudinal direction of the shaft in addition to a full length layer provided wholly in the longitudinal direction of the shaft. The partial layer can be provided in a tip portion of the shaft, a rear end of the shaft, a central portion of the shaft and the like, for example. It is possible to select a position, a length and a thickness of the partial layer and the like. By the partial layer, it is possible to enhance a degree of freedom of design in the shaft. The enhancement in the degree of freedom of design can contribute to an increase in a flight distance and an improvement in a hitting feeling.

In recent years, there is a tendency that a resilience coefficient of a golf club head is regulated. It has been hard to increase the flight distance depending on the characteristic of the head. For this reason, it has been required to increase the flight distance depending on the characteristic of the shaft. A lightweight shaft contributes to the increase in the flight distance. Since the partial layer can selectively reinforce a portion having a low strength, it is useful for a reduction in the weight of the shaft.

However, it has been found that a durability of the shaft is apt to be deteriorated due to the presence of the partial layer. Furthermore, it has been found that the durability of the shaft is particularly apt to be deteriorated if a large number of partial layers are provided.

It is an object of the present invention to provide a golf club shaft which has a partial layer and can enhance a durability.

A shaft according to the present invention is obtained by winding and curing a prepreg sheet including a matrix resin and a fiber. The sheet includes a full length sheet provided wholly in a longitudinal direction of the shaft and a partial sheet provided partially in the longitudinal direction of the shaft. The number of the full length sheets is equal to or greater than two. The number of the partial sheets is equal to or greater than four. When four sections obtained by dividing the shaft into four equal parts in the longitudinal direction are set to be first, second, third and fourth sections from a tip end side in order, the total number of end(s) of the partial sheets positioned in the first section is represented as N1, the total number of end(s) of the partial sheets positioned in the second section is represented as N2, the total number of end(s) of the partial sheets positioned in the third section is represented as N3, and the total number of end(s) of the partial sheets positioned in the fourth section is represented as N4, all of N1, N2, N3 and N4 are equal to or greater than one.

It is preferable that a difference (Nx−Nn) should be equal to or smaller than four when a maximum value of N1, N2, N3 and N4 is represented as Nx and a minimum value of N1, N2, N3 and N4 is represented as Nn.

It is preferable that a ratio (Px/Pn) should be equal to or lower than 1.5 when the total number of the sheets belonging to the first section is represented as P1, the total number of the sheets belonging to the second section is represented as P2, the total number of the sheets belonging to the third section is represented as P3, the total number of the sheets belonging to the fourth section is represented as P4, a maximum value of P1, P2, P3 and P4 is represented as Px, and a minimum value of P1, P2, P3 and P4 is represented as Pn.

A golf club according to the present invention comprises a head, a grip and a golf club shaft. The golf club shaft is obtained by winding and curing a prepreg sheet including a matrix resin and a fiber. The sheet includes a full length sheet provided wholly in a longitudinal direction of the shaft and a partial sheet provided partially in the longitudinal direction of the shaft. The number of the full length sheets is equal to or greater than two. The number of the partial sheets is equal to or greater than four. When four sections obtained by dividing the shaft into four equal parts in the longitudinal direction are set to be first, second, third and fourth sections from a tip end side in order, the total number of end(s) of the partial sheets positioned in the first section is represented as N1, the total number of end(s) of the partial sheets positioned in the second section is represented as N2, the total number of end(s) of the partial sheets positioned in the third section is represented as N3, and the total number of end(s) of the partial sheets positioned in the fourth section is represented as N4, all of N1, N2, N3 and N4 are equal to or greater than one.

In the golf club shaft according to the present invention in which the partial sheet is distributed in the longitudinal direction of the shaft, the end of the partial sheet is distributed in the longitudinal direction of the shaft. In the shaft, a stress acting on the end of the partial sheet is distributed. Therefore, a durability can be enhanced.

DESCRIPTION OF THE PREFERRED EMBODIMENTS

The present invention will be described below in detail based on a preferred embodiment with reference to the drawings.

Figure 1:
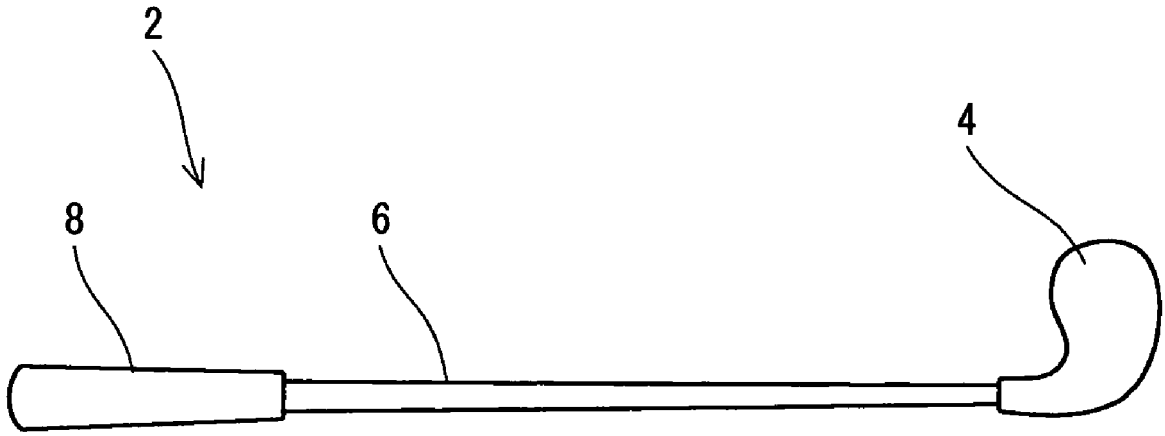
FIG. 1 is a general view showing a golf club according to an embodiment of the present invention.

As shown in FIG. 1, a golf club 2 has a head 4, a shaft 6 and a grip 8. The head 4 is attached to one of ends of the shaft 6. The grip 8 is attached to the other end of the shaft 6.

The head 4 and the grip 8 are not restricted. Examples of the head 4 include a wood type golf club head, an iron type golf club head, a so-called utility type head, a patter head and the like.

Figure 2:
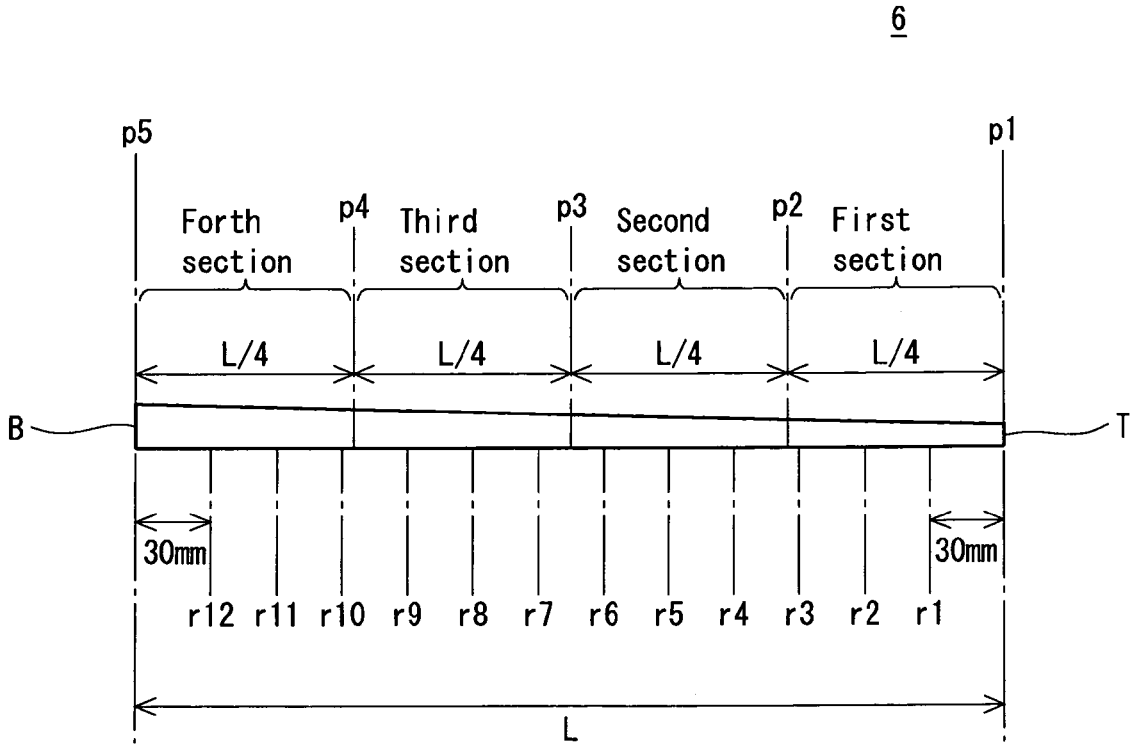
FIG. 2 is a general view showing a shaft attached to the golf club in FIG. 1.

FIG. 2 is a general view showing the shaft 6. The shaft 6 takes a tubular shape. The shaft 6 has a tip end T and a butt end B. The head 4 is attached to the tip end T. The grip 8 is attached to the butt end B. In the golf club 2, the tip end T is positioned in a shaft hole of the head 4. In the golf club 2, the butt end B is positioned in a shaft inserting hole of the grip 8. An external surface of the shaft 6 is tapered. The tapered surface has a diameter reduced toward the tip end T. An outside diameter of the tip end T is smaller than that of the butt end B.

The shaft 6 is a so-called carbon shaft. The shaft 6 is obtained by curing a prepreg sheet. In a typical prepreg sheet, a fiber is oriented in one direction. The prepreg sheet has a fiber and a matrix resin. Typically, the fiber is a carbon fiber. Typically, the matrix resin is a thermosetting resin.

The shaft 6 is manufactured by a so-called sheet winding process. The shaft 6 is obtained by winding and curing a prepreg sheet. The curing can be achieved by heating. A process for manufacturing the shaft 6 includes a heating step. Through the heating step, the matrix resin of the prepreg sheet is cured.

Figure 3:
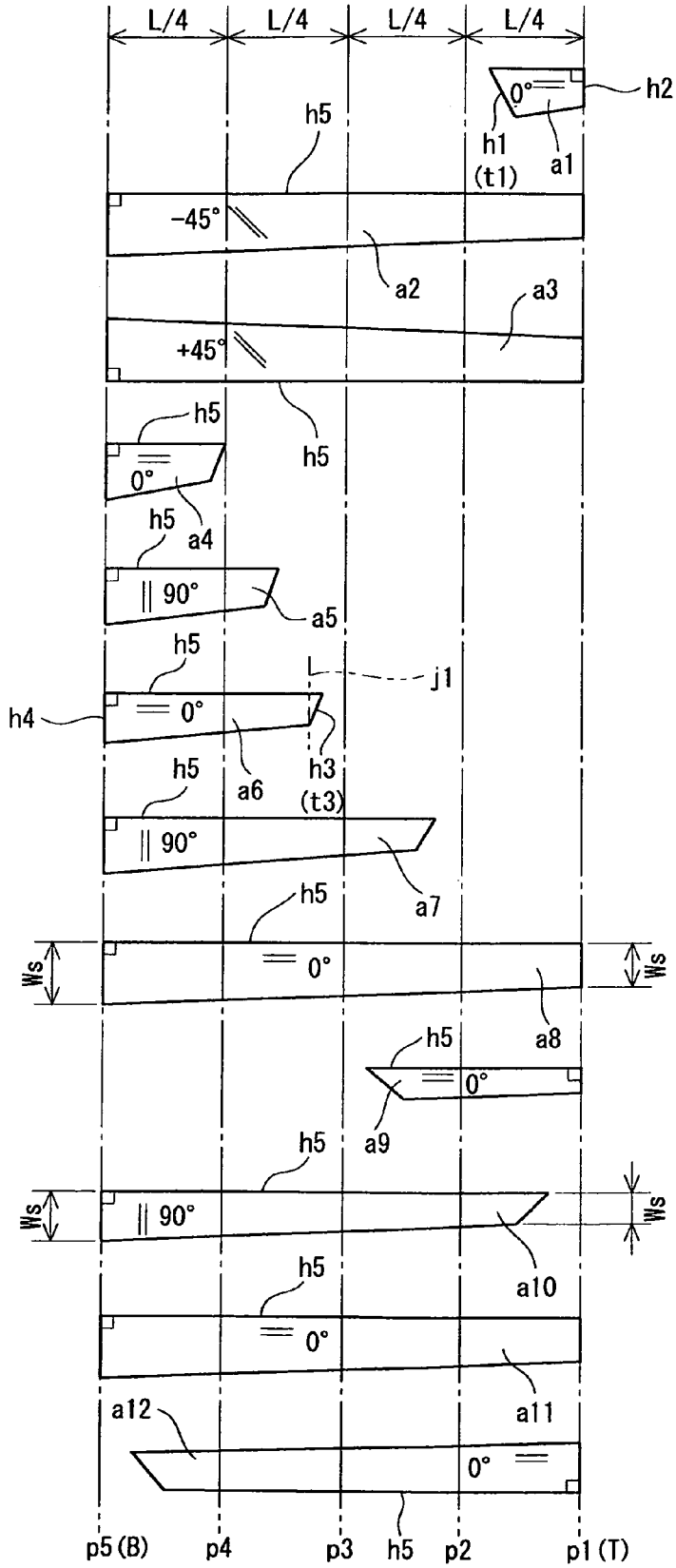
FIG. 3 is a developed view showing the shaft in FIG. 2 (a view showing a structure of a sheet)

FIG. 3 is a developed view showing the prepreg sheet constituting the shaft 6 (a view showing a structure of the sheet). The shaft 6 is constituted by a plurality of sheets. More specifically, the shaft 6 is constituted by 12 sheets of a1 to a12. In the developed views of FIG. 3 and the like, the sheets constituting the shaft are shown in order from an inside in a radial direction of the shaft. The wound sheet constitutes a layer. In a perpendicular shaft section to an axis of the shaft, the layer takes a spiral shape. In the developed views, the sheet positioned on an upper side is placed on an inside in the radial direction of the shaft. In the developed views of FIG. 3 and the like, a transverse direction of the drawings is coincident with a longitudinal direction of the shaft (an axial direction of the shaft). In the developed views of FIG. 3 and the like, a right side in the drawings indicates a tip end side of the shaft. In the developed views of FIG. 3 and the like, a left side of the drawings indicates a butt end side of the shaft.

The shaft 6 has a straight layer, an angle layer and a hoop layer. In the developed views of FIG. 3 and the like, an orientation angle of a fiber is described. A sheet described as "0°" constitutes the straight layer. A sheet described as "90°" constitutes the hoop layer. Sheets described as "−45°" and "+45°" constitute the angle layer.

In the straight layer, an orientation of a fiber is substantially parallel with the axial direction of the shaft. Due to an error made in winding or the like, usually, the orientation of the fiber is not perfectly parallel with the axial direction of the shaft. In the straight layer, an angle Af formed by the orientation of the fiber and the axial direction of the shaft is equal to or greater than approximately −10 degrees and is equal to or smaller than approximately +10 degrees. In the shaft 6, the straight layer is constituted by the sheets a1, a4, a6, a8, a9, a11 and a12. The straight layer has a high correlation with a bending rigidity and a bending strength in the shaft.

The angle layer is provided to enhance a torsional rigidity and a torsional strength in the shaft. The angle layer is constituted by at least two sheets in which orientations of fibers are reverse to each other. The angle layer includes a layer having the angle Af which is equal to or greater than −60 degrees and is equal to or smaller than −30 degrees and a layer having the angle Af which is equal to or greater than 30 degrees and is equal to or smaller than 60 degrees. In the shaft 6, the angle layer is constituted by the sheets a2 and a3.

The hoop layer is provided to enhance a crushing rigidity and a crushing strength in the shaft. The crushing rigidity indicates a rigidity against a force for crushing the shaft inward in a radial direction thereof. The crushing strength indicates a strength against the force for crushing the shaft inward in the radial direction. The crushing strength can also be related to the bending strength. A crushing deformation can be generated interlockingly with a bending deformation. In a lightweight shaft having a small thickness, particularly, an interlocking property is great. By an enhancement in the crushing strength, it is also possible to improve the bending strength.

In the hoop layer, an orientation of a fiber is substantially perpendicular to the axial direction of the shaft. In other words, in the hoop layer, the orientation is substantially parallel with a circumferential direction of the shaft. Due to an error made in winding or the like, usually, the orientation of the fiber is not perfectly perpendicular to the axial direction of the shaft. In the hoop layer, the angle Af is usually 90 degrees±10 degrees. In the shaft 6, the hoop layer is constituted by the sheets a5, a7 and a10.

In a manufacture of the shaft 6, a cored bar (mandrel) is prepared. The cored bar has a circular section. An external surface of the cored bar is tapered. In an embodiment of FIG. 3, first of all, the sheet a1 is wound around the cored bar. Next, the sheets a2 and a3 are wound around the cored bar having the sheet a1 wound therearound. Before the winding, the sheet a3 is stuck to the sheet a2. At this time, the sheet a3 is turned over. By the sticking, the fibers of the sheets a2 and a3 are oriented in reverse directions to each other. In this respect, in FIG. 3, an angle of the fiber of the sheet a2 is set to be −45 degrees and that of the fiber of the sheet a3 is set to be +45 degrees. The sheets stuck to each other are wound. Next, the sheet a4 is wound. The sheets a5, a6, a7, a8, a9, a10, a11 and a12 are wound in this order. A step of winding the sheet is also referred to as a winding step. As described above, each of the wound sheets forms the layer. Subsequently, a wrapping step is carried out. A wrapping tape formed of polypropylene or the like is wound. Through the wrapping step, air in the sheet layer is discharged. Then, a heating step is executed. Through the heating step, the matrix resin is cured. After the curing, the cored bar is pulled out. After the wrapping tape is removed, a finishing step such as polishing is carried out.

The developed views of FIG. 3 and the like also show an arrangement in the longitudinal direction of the shaft of each sheet in addition to order for winding each sheet. For example, one of ends of the sheet a1 is positioned on a tip end T (a position p1). For example, the other end of the sheet a4 is positioned on a butt end B (a position p5).

In the present invention, first, second, third and fourth sections are defined. As shown in FIG. 2, four sections obtained by dividing the shaft 6 into four equal parts in the longitudinal direction are set to be the first, second, third and fourth sections from the tip end side in order. When a full length of the shaft is represented as L, the first section has a length of L/4, the second section has a length of L/4, the third section has a length of L/4 and the fourth section has a length of L/4 (see FIG. 2).

As shown in FIG. 2, the first section is placed from the position p1 to a position p2. The second section is placed from the position p2 to a position p3. The third section is placed from the position p3 to a position p4. The fourth section is placed from the position p4 to the position p5. The tip end T is present in the position p1. The butt end B is present in the position p5. The positions p1, p2, p3, p4 and p5 are also shown in the developed views of FIG. 3 and the like. The position p2 indicates a boundary between the first and second sections. The position P3 indicates a boundary between the second and third sections. The position p4 indicates a boundary between the third and fourth sections.

A plurality of sheets constituting the shaft 6 includes a full length sheet provided wholly in the longitudinal direction of the shaft and a partial sheet provided partially in the longitudinal direction of the shaft. In an embodiment shown in FIG. 3, the full length sheet includes the sheets a2, a3, a8 and a11. The number of the full length sheets is four. In the embodiment shown in FIG. 3, the partial sheet includes the sheets a1, a4, a5, a6, a7, a9, a10 and a12. The number of the partial sheets is eight.

As shown in FIG. 3, all of the sheets a1 to a12 take square shapes. In the sheets a1 to a12, at least one of four angles is set to be a right angle. In the full length sheets (the sheets a2, a3, a8 and a11), two of the four angles are right angles. In the partial sheets (the sheets a1, a4, a5, a6, a7, a9, a10 and a12), one of the four angles is a right angle.

In the present invention, the position of the end in each partial sheet is distributed in the longitudinal direction of the shaft. It was found that a stress concentration on the end of the partial layer can be relaxed and a durability of the shaft can be enhanced by the distribution.

In the present invention, the ends of the partial sheet are distributed into all of the four sections. When the total number of the ends of the partial sheet which are positioned in the first section is represented as N1, the total number of the ends of the partial sheet which are positioned in the second section is represented as N2, the total number of the ends of the partial sheet which are positioned in the third section is represented as N3, and the total number of the ends of the partial sheet which are positioned in the fourth section is represented as N4, all of N1, N2, N3 and N4 are equal to or greater than one.

The end of the partial sheet is positioned on one of sides (the tip end T side) or the other side (the butt end B side) in the longitudinal direction of the shaft. The end of the partial sheet is present in a position excluding the tip end T and the butt end B. For example, in the embodiment shown in FIG. 3, the trapezoidal sheet a1 has four sides. In the four sides, a side h1 positioned on the butt end B side (see FIG. 3) indicates an end t1 of the partial sheet a1. Since a side h2 of the sheet a1 is positioned on the tip end T, it is not regarded to be the end of the partial sheet in the present invention. For example, in the embodiment shown in FIG. 3, the trapezoidal sheet a6 has four sides. In the four sides, a side h3 positioned on the tip end T side indicates an end t3 of the partial sheet. Since a side h4 of the sheet a6 is positioned on the butt end B, it is not regarded to be the end of the partial sheet in the present invention.

In the case in which the partial sheet takes a triangular shape, any of sides of the triangle is not regarded to be the end of the partial sheet. In the case in which the partial sheet takes the triangular shape, it is regarded to have no end.

The side h1 constituting the end t1 of the partial sheet a1 is inclined to the axial direction of the shaft. By the inclination, the end t1 is distributed in the longitudinal direction of the shaft. By the distribution, a stress concentration can be relaxed. As shown in FIG. 3, also in the other partial sheets, the side constituting the end is inclined to the axial direction of the shaft. For example, the side h3 is inclined to the axial direction of the shaft.

In the embodiment shown in FIG. 3, the end of the sheet a1 and that of the sheet a10 are positioned in the first section. Accordingly, the N1 is two. In the embodiment shown in FIG. 3, the end of the sheet a7 and that of the sheet a9 are positioned in the second section. Accordingly, the N2 is two. The end of the sheet a5 and that of the sheet a6 are positioned in the third section. Accordingly, the N3 is two. The end of the sheet a4 and that of the sheet a12 are positioned in the fourth section. Accordingly, the N4 is two.

The position of the end of the partial sheet is determined by a middle point of the end. For example, in a partial sheet z1 shown in FIG. 4, a middle point Ma of an end ta determines a position of the end ta. Accordingly, the end ta is positioned in the third section.

It is assumed that the boundary p2 belongs to the first section, the boundary p3 belongs to the second section and the boundary p4 belongs to the third section. Accordingly, in the case in which the middle point of the end is positioned on the boundary p3, for example, the end is assumed to belong to the second section.

When a maximum value of N1, N2, N3 and N4 is represented as Nx and a minimum value of N1, N2, N3 and N4 is represented as Nn, it is preferable that a difference (Nx−Nn) should be equal to or smaller than four. Consequently, the position of the end of the partial sheet is further distributed. Therefore, the durability of the shaft can be enhanced still more. In the embodiment shown in FIG. 3, Nx is two, Nn is two and the difference (Nx−Nn) is zero.

In the present invention, the total number of the sheets belonging to the respective sections is taken into consideration. The total number of the sheets belonging to the first section is represented as P1, the total number of the sheets belonging to the second section is represented as P2, the total number of the sheets belonging to the third section is represented as P3, and the total number of the sheets belonging to the fourth section is represented as P4.

Figure 4:
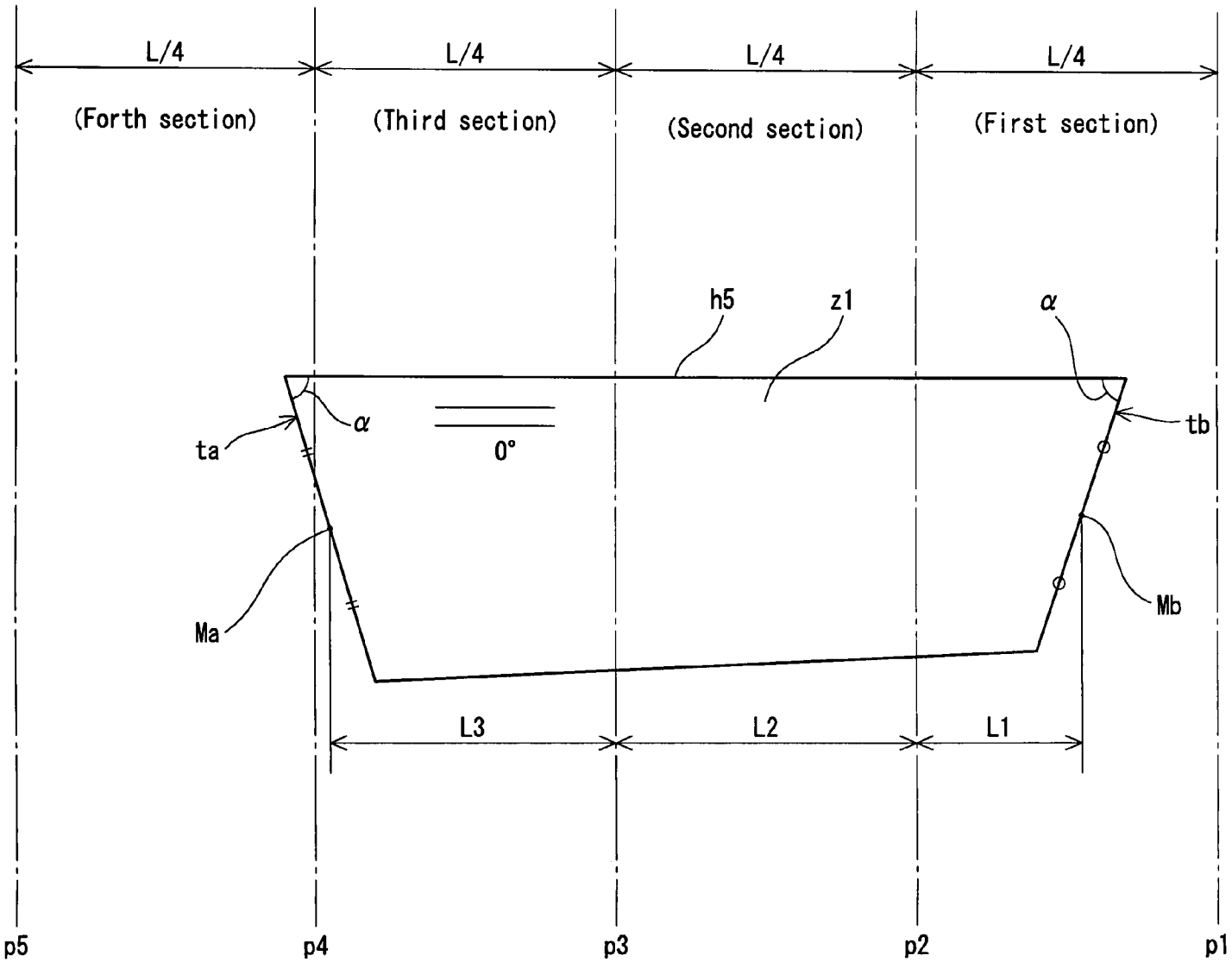
FIG. 4 is a view for explaining the number of sheets and a position of a sheet end.

In order to calculate P1 to P4, the number of the sheets in each of the sections is counted. A method of counting the number of the sheets will be described with reference to FIG. 4. The partial sheet z1 shown in FIG. 4 is disposed over a full length of the second section. In other words, a length L2 of the portion belonging to the second section is equal to L/4. Referring to the partial sheet z1, accordingly, the number of the sheets belonging to the second section is one. On the other hand, the partial sheet z1 is not disposed over the full length of the first section. In this case, the number of the sheets belonging to the first section is proportionally calculated from a length of the partial sheet z1 belonging to the first section. For example, when a length L1 in FIG. 4 is 0.6 time as great as (L/4), the number of the partial sheets z1 belonging to the first section is set to be 0.6. A point Mb to be a reference of the length L1 is set to be a middle point of an end tb. More specifically, the length of the sheet to be the reference for counting the number of the sheets is determined by the middle point of the end. Similarly, when a length L3 in FIG. 4 is 0.9 time as great as (L/4), for example, the number of the partial sheets z1 belonging to the third section is set to be 0.9.

The numbers of all the sheets are counted. The numbers of both the full length sheets and the partial sheets are counted. The number of the sheets is counted irrespective of the shape of the sheet.

The number of the sheets is different from that of plies. In the present application, the number of plies indicates the number of winds. For example, in the sheet a8 of FIG. 3, the number of plies in the sheet a8 is increased when a sheet width Ws (see FIG. 3) is made greater. However, the number of the sheets a8 is one irrespective of the number of plies. If a sheet makes three rounds in a circumferential direction in the section of the shaft, the number of plies of the sheet is three and the number of the sheets is one. The sheet width Ws is determined in the respective positions in the longitudinal direction of the shaft.

The P1 to the P4 are obtained by totalizing the numbers of the sheets thus counted every section. For example, in the embodiment shown in FIG. 3, the number of the sheets belonging to the first section is 0.7 for the sheet a1, one for the sheet a2, one for the sheet a3, one for the sheet a8, one for the sheet a9, 0.5 for the sheet a10, one for the sheet a11, and one for the sheet a12. Accordingly, the P1 is [0.7+1+1+1+1+0.5+1+1]=7.2. By carrying out the calculation in the same manner, P2 of 7.2, P3 of 8.0 and P4 of 9.4 are obtained.

When a maximum value of P1, P2, P3 and P4 is represented as Px and a minimum value of P1, P2, P3 and P4 is represented as Pn, it is preferable that a ratio (Px/Pn) should be equal to or lower than 1.5. Consequently, the number of the sheets is distributed into each section. Therefore, it is possible to enhance the durability of the shaft. In the embodiment shown in FIG. 3, the ratio (Px/Pn) is 1.31 because Px is 9.4 and Pn is 7.2.

In respect of the durability of the shaft, the number of the full length sheets is preferably equal to or greater than two and is more preferably equal to or greater than three. In respect of a lightweight property and a productivity in the shaft, the number of the full length sheets is preferably equal to or smaller than eight and is more preferably equal to or smaller than six.

In respect of the durability of the shaft, the number of the plies of the full length sheet is preferably equal to or greater than four, is more preferably equal to or greater than six, and is further preferably equal to or greater than eight. In respect of the lightweight property and the productivity in the shaft, the number of the plies of the full length sheet is preferably equal to or smaller than 12 and is more preferably equal to or smaller than 10.

It is preferable that the full length layer constituted by the full length sheet should include a layer having the angle Af which is equal to or greater than −60 degrees and is equal to or smaller than −30 degrees and a layer having the angle Af which is equal to or greater than 30 degrees and is equal to or smaller than 60 degrees. These can enhance a torsional rigidity, a bending rigidity and a crushing rigidity. Furthermore, it is preferable that the full length layer should include a layer having the angle Af which is equal to or greater than −10 degrees and is equal to or smaller than 10 degrees. This layer can enhance the bending rigidity.

In the case in which a large number of partial sheets are provided, a degree of freedom of design can be enhanced. In respect of the degree of freedom of design, the number of the partial sheets is preferably equal to or greater than four, is more preferably equal to or greater than five, is more preferably equal to or greater than six, and is further preferably equal to or greater than seven. In respect of an enhancement in the productivity, the number of the partial sheets is preferably equal to or smaller than 16, is more preferably equal to or smaller than 12, and is further preferably equal to or smaller than 10.

All of N1, N2, N3 and N4 are set to be equal to or greater than one so that the degree of freedom of design is enhanced and the position of the end of the partial sheet is distributed in the longitudinal direction of the shaft. By the distribution, the stress concentration can be relaxed and the durability of the shaft can be enhanced. N1, N2, N3 and N4 have no upper limit. In respect of a suppression in a reduction in the productivity with an increase in the number of the sheets, it is preferable that all of N1, N2, N3 and N4 should be equal to or smaller than four.

If the difference (Nx−Nn) is great, the end of the partial sheet easily concentrates in a specific section. For this reason, the stress concentration is apt to be generated in the same section. In respect to an enhancement in the durability through a relaxation of the stress concentration, the difference (Nx−Nn) is preferably equal to or smaller than four, is more preferably equal to or smaller than three and is further preferably equal to or smaller than two.

If the ratio (Px/Pn) is high, the stress easily concentrates in a section in which the total number of the sheets is Pn. Consequently, the durability is apt to be deteriorated. In respect of the enhancement in the durability through the relaxation of the stress concentration, the ratio (Px/Pn) is preferably equal to or lower than 1.5, is more preferably equal to or lower than 1.4 and is further preferably equal to or lower than 1.35.

When a number Lh of plies constituted by a full length sheet is increased, the sheet width Ws is made greater. If the sheet width Ws is excessively great, winding failures such as wrinkles are easily generated. In this respect, the number Lh of plies is preferably equal to or smaller than four, is more preferably equal to or smaller than three and is further preferably equal to or smaller than two. In respect of an enhancement in a uniformity in the circumferential direction of the shaft, it is preferable that the number Lh of plies should be equal to or greater than one.

When a number Lp of plies constituted by a partial sheet is increased, the sheet width Ws is made greater. If the sheet width Ws is excessively great, winding failures such as wrinkles are easily generated. In this respect, the number Lp of plies is preferably equal to or smaller than four, is more preferably equal to or smaller than three and is further preferably equal to or smaller than two. In respect of an enhancement in a uniformity in the circumferential direction of the shaft, it is preferable that the number Lp of plies should be equal to or greater than one except for a portion constituting an end. The portion constituting an end implies a portion formed by an inclined end to the axial direction of the shaft. For example, in the sheet a6 shown in FIG. 3, a portion provided in contact with the side h3 (the end t3) acts as the portion constituting an end. In the sheet a6, a portion on the tip end T side from a two-dotted chain line j1 acts as the portion constituting an end.

In respect of an enhancement in the strength and the productivity, thicknesses of the full length sheet and the partial sheet are preferably equal to or greater than 0.025 mm, are more preferably equal to or greater than 0.058 mm, and are further preferably equal to or greater than 0.083 mm. In respect of a lightweight property, the thicknesses of the full length sheet and the partial sheet are preferably equal to or smaller than 0.150 mm, are more preferably equal to or smaller than 0.145 mm and are further preferably equal to or smaller than 0.136 mm.

In respect of an enhancement in a strength, fiber content rates of the full length sheet and the partial sheet are preferably equal to or higher than 60% by mass, are more preferably equal to or higher than 63% by mass and are further preferably equal to or higher than 70% by mass. If the fiber content rate is excessively high, a content rate of the matrix resin is reduced so that a tacking property of the sheet is deteriorated. Due to the deterioration in the tacking property, the winding failures such as wrinkles are apt to be generated. In this respect, the fiber content rates of the full length sheet and the partial sheet are preferably equal to or lower than 85% by mass, are more preferably equal to or lower than 80% by mass and are further preferably equal to or lower than 75% by mass.

The shape of the full length sheet is not restricted. In the case in which the numbers of the plies in all of the positions in the longitudinal direction of the shaft are set to be equal to each other, the full length sheet takes a trapezoidal shape shown in FIG. 3. In the full length sheets, the sheet width Ws is more reduced closer to the tip end T. The shape of the sheet corresponds to the taper shape of the shaft.

The shape of the partial sheet is not restricted. Examples of the shape of the partial sheet include a polygon such as a triangle or a square. In respect of a forming property (a workability in the winding step), it is preferable that the partial sheet should take a square shape.

The partial sheet and the full length sheet have a parallel side h5 which is almost parallel with the longitudinal direction of the shaft (see FIGS. 3 and 4). An absolute value of an angle formed by the parallel side h5 and the axial direction of the shaft is preferably equal to or smaller than 10 degrees and is more preferably equal to or smaller than five degrees. By setting the parallel side h5 to be parallel with the longitudinal direction of the shaft, the designed shaft is produced.

An angle $\alpha$ formed by a side constituting the end and the parallel side h5 is shown in FIG. 4. In respect of the forming property, an absolute value of the angle $\alpha$ is preferably equal to or greater than 30 degrees, is more preferably equal to or greater than 45 degrees and is further preferably equal to or greater than 60 degrees. An upper limit of the angle $\alpha$ is 90 degrees. In respect of a distribution of an end of a partial sheet in the axial direction of the shaft, the angle $\alpha$ is preferably equal to or smaller than 80 degrees and is more preferably equal to or smaller than 70 degrees.

In respect of a strength, a weight of the shaft is preferably equal to or greater than 30 g, is more preferably equal to or greater than 34 g and is further preferably equal to or greater than 38 g. A lightweight shaft can enhance a head speed and a flight distance. In this respect, the weight of the shaft is preferably equal to or smaller than 60 g, is more preferably equal to or smaller than 58 g, and is further preferably equal to or smaller than 56 g.

A specific example of the prepreg sheet which can be used in the present invention is not restricted. The following Table 1 shows an example of a prepreg sheet on the market which can be used in the present invention. The Table 1 shows an item number of the prepreg sheet, an item number of a carbon fiber used in the prepreg sheet, a tensile modulus of elasticity of the carbon fiber, a tensile strength of the carbon fiber, a thickness of the prepreg sheet, and a fiber content rate. The prepreg sheet shown in the Table 1 is manufactured by TORAY INDUSTRIES, INC. or MITSUBISHI RAYON CO., LTD. In the present invention, it is also possible to use a fabric sheet obtained by weaving a fiber in addition to a UD prepreg sheet (a unidirection prepreg sheet). As described in the Table 1, TR1100M, TR1120M and TR3110M manufactured by the MITSUBISHI RAYON CO., LTD. can be used as the fabric sheet, for example. TR1100M, TR1120M and TR3110M manufactured by the MITSUBISHI RAYON CO., LTD. are prepreg sheets in which a plain weave fabric is impregnated with a resin.

In respect of the strength and the elastic modulus, a carbon fiber is preferable for a fiber constituting the prepreg sheet. In respect of the strength, the tensile strength of the fiber constituting the sheet is preferably equal to or greater than 300 kgf/mm$^2$, is more preferably equal to or greater than 400 kgf/mm$^2$, and is further preferably equal to or greater than 500 kgf/mm$^2$. In consideration of physical properties of available carbon fibers, it is preferable that the tensile strength of the fiber should be equal to or smaller than 680 kgf/mm$^2$.

The shaft according to the present invention may have a hoop layer. The hoop layer is formed by a fiber reinforced resin and has an orientation angle of a fiber which is substantially perpendicular to the axis of the shaft. 805S-3 manufactured by the TORAY INDUSTRIES, INC. which is described in the following Table 1 or the like is used as the hoop layer, for example. As compared with other types of the prepreg, 805S-3 has a smaller weight per unit area and a smaller carbon fiber mass per unit area, and a smaller thickness. Since such a thin prepreg can easily be wound while the carbon fiber is bent, it is suitable for the hoop layer.

TABLE 1

Example of Available Prepreg Sheet

| | | Physical Property Value of Carbon Fiber | | | | |
|---|---|---|---|---|---|---|
| Manufacturer | Item Number of Prepreg Sheet | Item Number of Carbon Fiber | Tensile Modulus of Elasticity (t/mm$^2$) | Tensile Strength (kgf/mm$^2$) | Thickness of Sheet (mm) | Fiber Content Rate (% by mass) |
| Manufactured by TORAY INDUSTRIES, INC. | 3255S-10 | T700S | 23.5 | 500 | 0.082 | 76 |
| Manufactured by TORAY INDUSTRIES, INC. | 3255S-12 | T700S | 23.5 | 500 | 0.103 | 76 |
| Manufactured by TORAY INDUSTRIES, INC. | 3255S-15 | T700S | 23.5 | 500 | 0.123 | 76 |
| Manufactured by TORAY INDUSTRIES, INC. | 3255G-10 | T700G | 24.5 | 500 | 0.082 | 76 |
| Manufactured by TORAY INDUSTRIES, INC. | 3255G-12 | T700G | 24.5 | 500 | 0.103 | 76 |
| Manufactured by TORAY INDUSTRIES, INC. | 8255S-15 | M30S | 30 | 560 | 0.127 | 76 |
| Manufactured by TORAY INDUSTRIES, INC. | 805S-3 | M30S | 30 | 560 | 0.034 | 60 |
| Manufactured by TORAY INDUSTRIES, INC. | 2255F-10 | T800H | 30 | 560 | 0.082 | 76 |
| Manufactured by TORAY INDUSTRIES, INC. | 2255F-12 | T800H | 30 | 560 | 0.102 | 76 |
| Manufactured by TORAY INDUSTRIES, INC. | 2255F-15 | T800H | 30 | 560 | 0.123 | 76 |
| Manufactured by TORAY INDUSTRIES, INC. | 2255G-10 | T800G | 30 | 630 | 0.082 | 76 |
| Manufactured by TORAY INDUSTRIES, INC. | 2255G-12 | T800G | 30 | 630 | 0.102 | 76 |
| Manufactured by TORAY INDUSTRIES, INC. | 2255G-15 | T800G | 30 | 630 | 0.123 | 76 |
| Manufactured by MITSUBISHI RAYON CO., LTD. | TR350C-100S | TR50S | 24 | 500 | 0.083 | 75 |
| Manufactured by MITSUBISHI RAYON CO., LTD. | MR350C-100S | MR40 | 30 | 450 | 0.085 | 75 |

TABLE 1-continued

| Example of Available Prepreg Sheet | | | | | | |
|---|---|---|---|---|---|---|
| | | Physical Property Value of Carbon Fiber | | | | |
| Manufacturer | Item Number of Prepreg Sheet | Item Number of Carbon Fiber | Tensile Modulus of Elasticity ($t/mm^2$) | Tensile Strength ($kgf/mm^2$) | Thickness of Sheet (mm) | Fiber Content Rate (% by mass) |
| Manufactured by MITSUBISHI RAYON CO., LTD. | HRX350C-075S | HR40 | 40 | 470 | 0.057 | 75 |
| Manufactured by MITSUBISHI RAYON CO., LTD. | TR1100M | TR40 | 24 | 400 | 0.120 | 60 |
| Manufactured by MITSUBISHI RAYON CO., LTD. | TR1120M | TR40 | 24 | 400 | 0.150 | 60 |
| Manufactured by MITSUBISHI RAYON CO., LTD. | TR3110M | TR30S | 24 | 300 | 0.223 | 60 |

Tensile strength and tensile modulus of elasticity have values measured in accordance with JIS R7601: 1986 "Carbon Fiber Testing Method"

When the full length L of the shaft is greater, the position of the sheet end is distributed in the longitudinal direction of the shaft more easily. In this respect, the full length L of the shaft is preferably equal to or greater than 35 inches (889 mm), is more preferably equal to or greater than 41 inches (1041 mm), is more preferably equal to or greater than 43 inches (1092 mm), is more preferably equal to or greater than 44 inches (1117 mm), and is particularly preferably equal to or greater than 45 inches (1143 mm). In respect of a maintenance of the strength of the shaft, the full length L of the shaft is preferably equal to or smaller than 52 inches (1321 mm), is more preferably equal to or smaller than 50 inches (1270 mm), and is particularly preferably equal to or smaller than 48 inches (1219 mm).

For the method of manufacturing a shaft according to the present invention, a sheet winding process is preferred. For the matrix resin of the prepreg sheet, it is possible to use a thermosetting resin, a thermoplastic resin and the like other than an epoxy resin in addition to the epoxy resin.

In the case in which the crushing rigidity in the butt portion (rear end) of the shaft is low, a crushing deformation in the radial direction of the shaft is increased in the butt portion. When the crushing deformation is increased, a head speed in hitting is apt to be decreased. In this respect, it is preferable to cause the crushing rigidity in the butt portion to be higher than that in the conventional art. The crushing deformation implies such a deformation that the sectional shape of the shaft is changed from a circle to an almost ellipse.

In respect of an enhancement in the crushing rigidity of the butt portion, a shaft to satisfy the following (A1) is preferred.

(A1) A position placed apart from the tip end T of the shaft by 30 mm is set to be a first position r1, a position placed apart from the butt end B of the shaft by 30 mm is set to be a twelfth position r12, positions for dividing a portion between the first position r1 and the twelfth position r12 into eleven equal parts are set to be a second position r2, a third position r3, a fourth position r4, a fifth position r5, a sixth position r6, a seventh position r7, an eighth position r8, a ninth position r9, a tenth position r10 and an eleventh position r11 from the chip end T side in order, crushing rigidities EI measured in twelve portions from the first position r1 to the twelfth position r12 are set to be EI (1), EI (2), EI (3), EI (4), EI (5), EI (6), EI (7), EI (8), EI (9), EI (10), EI (11) and EI (12) from the tip end T side in order, points obtained by plotting measured values in the twelve positions in an XY coordinate plane in which a distance (mm) from the tip end T of the measuring position is represented as an X axis and a value ($kgf/mm^2$) of the crushing rigidity EI is represented as a Y axis are set to be T (1), T (2), T (3), T (4), T (5), T (6), T (7), T (8), T (9), T (10), T (11) and T (12) from the tip end T side in order, respectively, a straight line K passing through the T (7) and the T (12) in the XY coordinate plane is expressed in an equation of [Y=aX+b7], values ($kgf/mm^2$) of Y-intercepts of straight lines which are parallel with the straight line K and pass through the T (1), T (2), T (3), T (4), T (5), T (6), T (8), T (9), T (10) and T (11) are represented as b1, b2, b3, b4, b5, b6, b8, b9, b10 and b11, respectively, and when a maximum value of the b7, b8, b9, b10 and b11 is represented as bmax, a gradient a of the straight line K is equal to or greater than −0.006 and is equal to or smaller than −0.003, all of the b8, b9, b10 and b11 are greater than b7, the bmax is b8, b9, b10 or b11, and (bmax−b7) is equal to or greater than 2 ($kgf/mm^2$) and is equal to or smaller than 12 ($kgf/mm^2$).

In the shaft to satisfy the (A1), a minimum value of the b1, b2, b3, b4, b5, b6, b7, b8, b9, b10 and b11 is more preferably b6 or b7 and is further preferably b7.

In the shaft to satisfy the (A1), it is more preferable that the following expression should be set up.

$$EI(1)>EI(2)>EI(3)>EI(4)>EI(5)>EI(6)$$

In the shaft to satisfy the (A1), it is more preferable that the following expression should be set up.

$$b1>b2>b3>b4>b5>b6$$

For a shaft which can achieve physical properties of the (A1), a shaft to satisfy the following (B1) is preferred.

(B1) there is provided a partial layer (a partial reinforced layer) which is constituted by a cloth layer including a plain weave fabric or a hoop layer, the partial layer has an end on the tip end T side which is provided on the butt end B side from the seventh position r7 and the end on the butt end B side which is provided on the tip end T side from the twelfth position r12, the partial layer is present in at least the ninth position r9, and a length Lz in the longitudinal direction of the shaft in the partial layer satisfies the following expression (F1).

$$[(L-60)\times(2/11)]\leqq Lz \quad \text{(F1)}$$

In the expression (F1), L represents a full length (mm) of the shaft.

The method of measuring the crushing rigidity is as follows. A shaft is cut in each position (W/2) at the chip end T side and the butt end B side in the axial direction of the shaft around a measuring point and a ring-shaped specimen having a length W is cut out. The specimen thus cut out is mounted on a pedestal jig and a load N is applied by an indenting jig. The load N is applied in an orthogonal direction to the axial direction of the shaft and a deformation δ(mm) of the specimen through the load N is measured. δ(mm) indicates a displacement of the indenting jig. The load N is uniformly applied in a longitudinal direction of the specimen. A crushing rigidity G is calculated in G=N/(δ×W). In the measuring method according to the present application, N is set to be 5 kgf and W is set to be 10 mm. A compressed surface is formed into a plane for the pedestal jig for mounting the specimen thereon and the indenting jig for applying the load.

The first position r1 to the twelfth position r12 are shown in FIG. 2.

EXAMPLES

Although the advantages of the present invention will be apparent from examples, the present invention should not be construed restrictively based on the description of the examples.

[Durability Test]

A durability was evaluated. A head and a grip were attached to a shaft to fabricate a golf club. The golf club was attached to "SHOT ROBO III-1" (trade name) manufactured by MIYAMAE CO, LTD. and was caused to repetitively hit a golf ball at a head speed of 54 m/s. The number of hitting operations was confirmed until the shaft was broken. The number of the hitting operations was indexed with that in a comparative example 1 set to be 100. The index is shown as a "durability test result (index)" in the following Tables 2 to 8. When the index is greater, the durability is more excellent.

Example 1

In the same manner as the shaft 6 according to the embodiment, there was obtained a shaft shown in the developed view of FIG. 3 (the view showing a structure of a sheet). For a manufacturing method, a sheet winding process was employed. A full length L of the shaft was set to be 1168 mm. TR350C-100S was used for a sheet a1, HRX350C-075S was used for a sheet a2, HRX350C-075S was used for a sheet a3, MR350C-100S was used for a sheet a4, 805S-3 was used for a sheet a5, MR350C-100S was used for a sheet a6, 805S-3 was used for a sheet a7, MR350C-100S was used for a sheet a8, MR350C-100S was used for a sheet a9, 805S-3 was used for a sheet a10, MR350C-100S was used for a sheet a11, and TR350C-100S was used for a sheet a12. A total of the sheets a2 and a3 was set to be three plies. The other sheets were set to be one ply, respectively. A portion constituting an end of a partial sheet has the number of plies which is smaller than one. A weight of the shaft was 47 g. In the example 1, N1 was two, N2 was two, N3 was two, and N4 was two. In the example 1, P1 was 7.2, P2 was 7.2, P3 was 8.0 and P4 was 9.4. Fiber orientation angles of the sheets a1 to a12 are shown in FIG. 3. The specification and evaluation result of the shaft is shown in the following Table 2.

TABLE 2

Specification and Evaluation Result of Example 1

| | | Fourth Section | Third Section | Second Section | First Section |
|---|---|---|---|---|---|
| Number of Sheet End | Each Section | 2 | 2 | 2 | 2 |
| | Nx | | 2 | | |
| | Nn | | 2 | | |
| | Difference (Nx − Nn) | | 0 | | |
| Number of Sheet in Each Section | a1 | 0.0 | 0.0 | 0.0 | 0.7 |
| | a2 | 1.0 | 1.0 | 1.0 | 1.0 |
| | a3 | 1.0 | 1.0 | 1.0 | 1.0 |
| | a4 | 0.8 | 0.0 | 0.0 | 0.0 |
| | a5 | 1.0 | 0.3 | 0.0 | 0.0 |
| | a6 | 1.0 | 0.7 | 0.0 | 0.0 |
| | a7 | 1.0 | 1.0 | 0.7 | 0.0 |
| | a8 | 1.0 | 1.0 | 1.0 | 1.0 |
| | a9 | 0.0 | 0.0 | 0.5 | 1.0 |
| | a10 | 1.0 | 1.0 | 1.0 | 0.5 |
| | a11 | 1.0 | 1.0 | 1.0 | 1.0 |
| | a12 | 0.6 | 1.0 | 1.0 | 1.0 |
| | Total Number of Sheet | 9.4 | 8.0 | 7.2 | 7.2 |
| | Px | | 9.4 | | |
| | Pn | | 7.2 | | |
| | Ratio (Px/Pn) | | 1.31 | | |
| Durability Test Result (Index) | | | 329 | | |

Example 2

Figure 5:
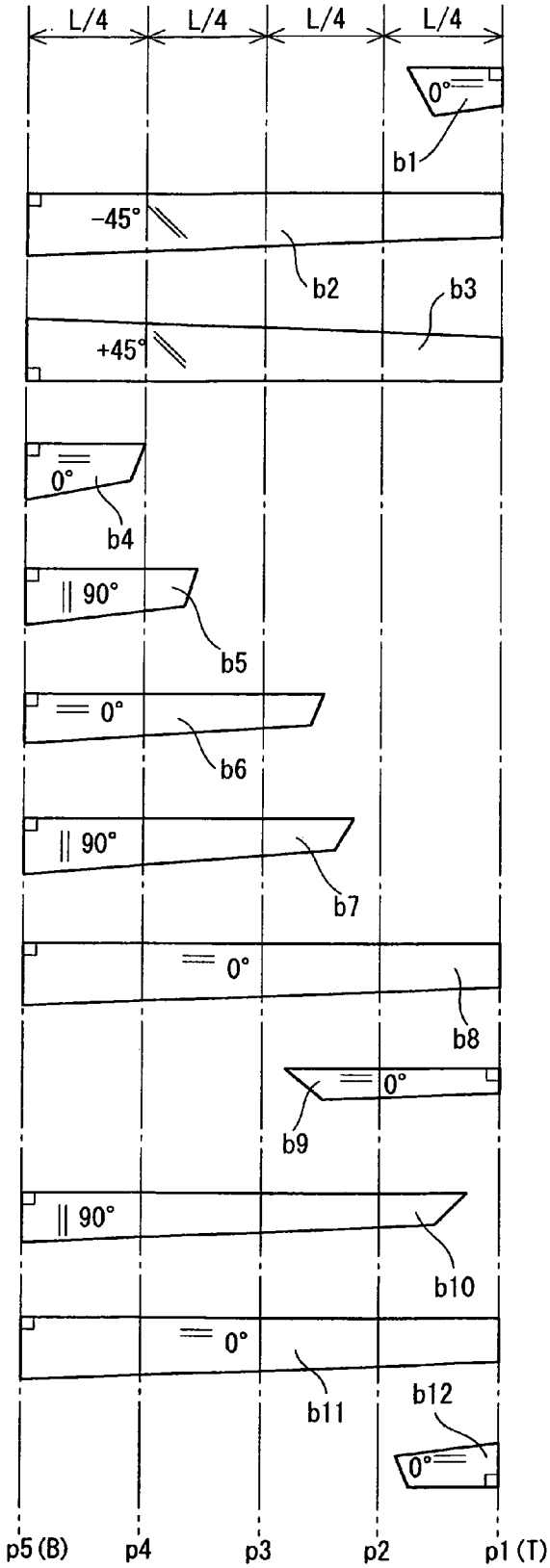
FIG. 5 is a developed view showing a shaft according to an example 2.

A shaft according to an example 2 was obtained in the same manner as in the example 1 except for the developed view of the shaft (the view showing a structure of a sheet) illustrated in FIG. 5. TR350C-100S was used for a sheet b1, HRX350C-075S was used for a sheet b2, HRX350C-075S was used for a sheet b3, MR350C-100S was used for a sheet b4, 805S-3 was used for a sheet b5, MR350C-100S was used for a sheet b6, 805S-3 was used for a sheet b7, MR350C-100S was used for a sheet b8, MR350C-100S was used for a sheet b9, 805S-3 was used for a sheet b10, MR350C-100S was used for a sheet b11, and TR350C-100S was used for a sheet b12. A total of the sheets b2 and b3 was set to be three plies. The other sheets were set to be one ply, respectively. A portion constituting an end of a partial sheet has the number of plies which is smaller than one. A weight of the shaft was 43 g. Fiber orientation angles of the sheets b1 to b12 are shown in FIG. 5. The specification and evaluation result of the shaft is shown in the following Table 3.

TABLE 3

Specification and Evaluation Result of Example 2

| | | Fourth Section | Third Section | Second Section | First Section |
|---|---|---|---|---|---|
| Number of Sheet End | Each Section | 1 | 1 | 3 | 3 |
| | Nx | | 3 | | |
| | Nn | | 1 | | |
| | Difference (Nx − Nn) | | 2 | | |
| Number of Sheet in Each Section | b1 | 0.0 | 0.0 | 0.0 | 0.7 |
| | b2 | 1.0 | 1.0 | 1.0 | 1.0 |
| | b3 | 1.0 | 1.0 | 1.0 | 1.0 |
| | b4 | 0.8 | 0.0 | 0.0 | 0.0 |
| | b5 | 1.0 | 0.3 | 0.0 | 0.0 |
| | b6 | 1.0 | 1.0 | 0.3 | 0.0 |
| | b7 | 1.0 | 1.0 | 0.7 | 0.0 |
| | b8 | 1.0 | 1.0 | 1.0 | 1.0 |
| | b9 | 0.0 | 0.0 | 0.5 | 1.0 |
| | b10 | 1.0 | 1.0 | 1.0 | 0.5 |
| | b11 | 1.0 | 1.0 | 1.0 | 1.0 |
| | b12 | 0.0 | 0.0 | 0.0 | 0.8 |
| | Total Number of Sheet | 8.8 | 7.3 | 6.5 | 7.0 |
| | Px | | 8.8 | | |
| | Pn | | 6.5 | | |
| | Ratio (Px/Pn) | | 1.35 | | |
| Durability Test Result (Index) | | | 281 | | |

Example 3

Figure 6:
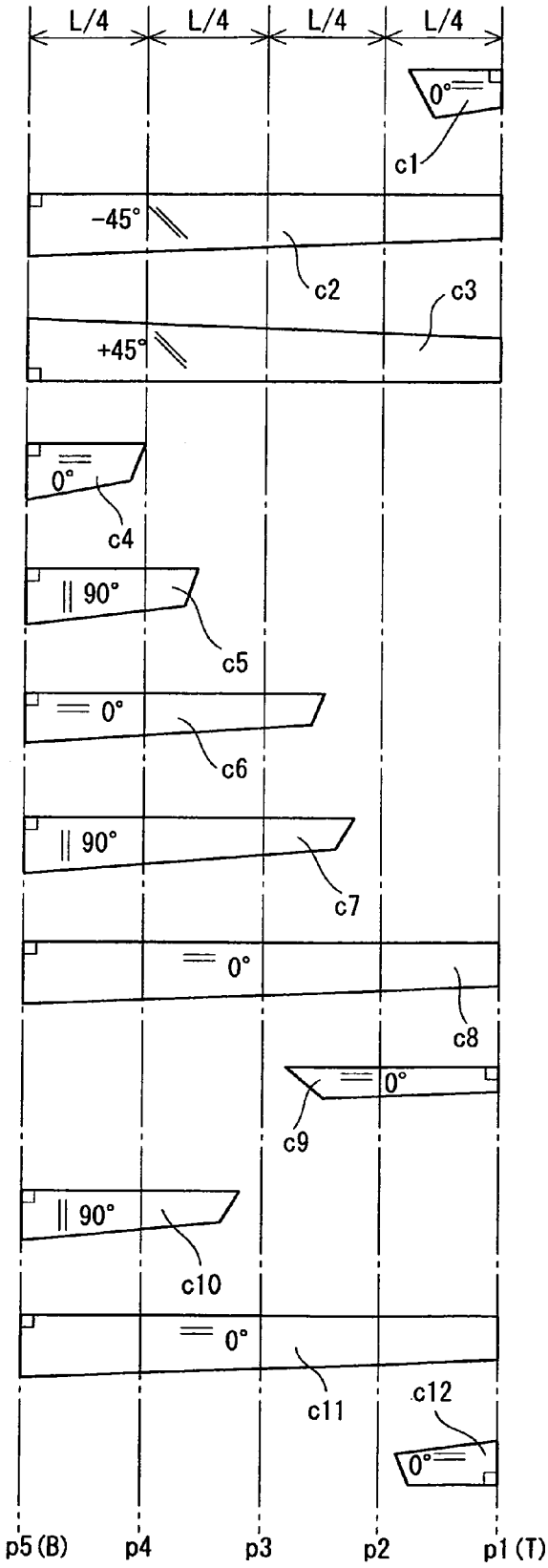
FIG. 6 is a developed view showing a shaft according to an example 3.

A shaft according to an example 3 was obtained in the same manner as in the example 1 except for the developed view of the shaft (the view showing a structure of a sheet) illustrated in FIG. 6. TR350C-100S was used for a sheet c1, HRX350C-075S was used for a sheet c2, HRX350C-075S was used for a sheet c3, MR350C-100S was used for a sheet c4, 805S-3 was used for a sheet c5, MR350C-100S was used for a sheet c6, 805S-3 was used for a sheet c7, MR350C-100S was used for a sheet c8, MR350C-100S was used for a sheet c9, 805S-3 was used for a sheet c10, MR350C-100S was used for a sheet c11, and TR350C-100S was used for a sheet c12. A total of the sheets c2 and c3 was set to be three plies. The other sheets were set to be one ply, respectively. A portion constituting an end of a partial sheet has the number of plies which is smaller than one. A weight of the shaft was 42 g. Fiber orientation angles of the sheets c1 to c12 are shown in FIG. 6. The specification and evaluation result of the shaft is shown in the following Table 4.

TABLE 4

Specification and Evaluation Result of Example 3

| | | Fourth Section | Third Section | Second Section | First Section |
|---|---|---|---|---|---|
| Number of Sheet End | Each Section | 1 | 2 | 3 | 2 |
| | Nx | | 3 | | |
| | Nn | | 1 | | |
| | Difference (Nx − Nn) | | 2 | | |
| Number of Sheet in Each Section | c1 | 0.0 | 0.0 | 0.0 | 0.7 |
| | c2 | 1.0 | 1.0 | 1.0 | 1.0 |
| | c3 | 1.0 | 1.0 | 1.0 | 1.0 |
| | c4 | 0.8 | 0.0 | 0.0 | 0.0 |
| | c5 | 1.0 | 0.3 | 0.0 | 0.0 |
| | c6 | 1.0 | 1.0 | 0.3 | 0.0 |
| | c7 | 1.0 | 1.0 | 0.7 | 0.0 |
| | c8 | 1.0 | 1.0 | 1.0 | 1.0 |
| | c9 | 0.0 | 0.0 | 0.5 | 1.0 |
| | c10 | 1.0 | 0.7 | 0.0 | 0.0 |
| | c11 | 1.0 | 1.0 | 1.0 | 1.0 |
| | c12 | 0.0 | 0.0 | 0.0 | 0.8 |
| | Total Number of Sheet | 8.8 | 7.0 | 5.5 | 6.5 |
| | Px | | 8.8 | | |
| | Pn | | 5.5 | | |
| | Ratio (Px/Pn) | | 1.60 | | |
| Durability Test Result (Index) | | | 209 | | |

Example 4

Figure 7:
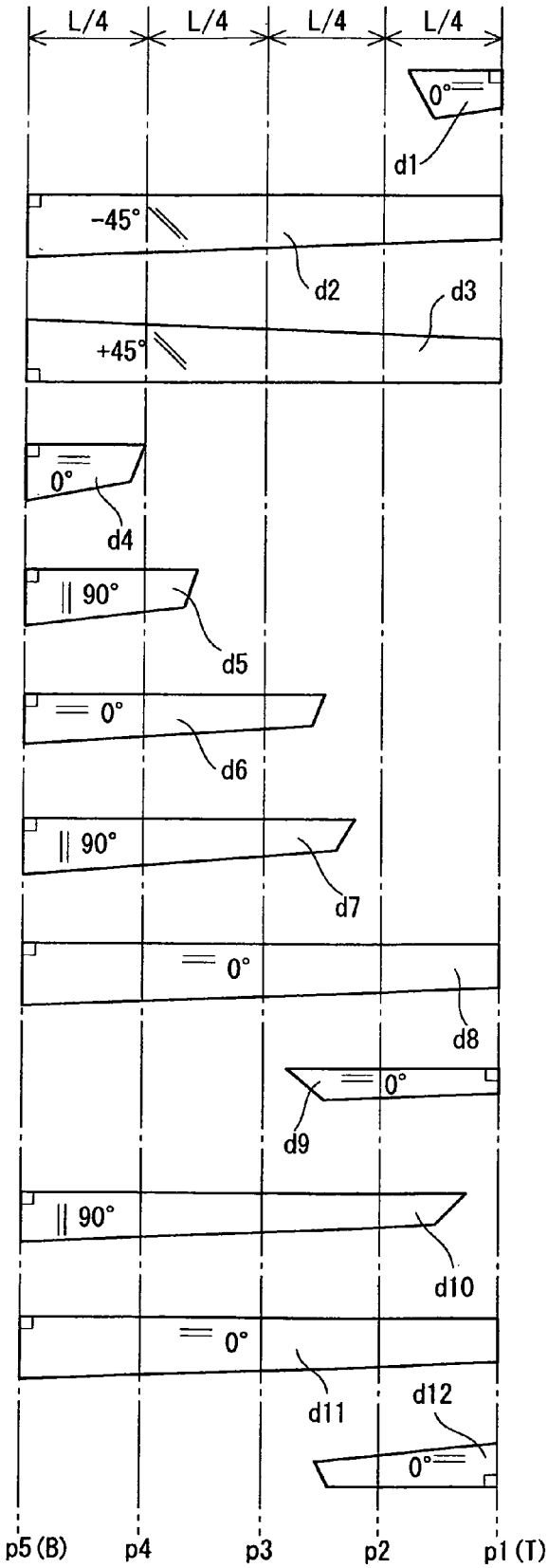
FIG. 7 is a developed view showing a shaft according to an example 4.

A shaft according to an example 4 was obtained in the same manner as in the example 1 except for the developed view of the shaft (the view showing a structure of a sheet) illustrated in FIG. 7. TR350C-100S was used for a sheet d1, HRX350C-075S was used for a sheet d2, HRX350C-075S was used for a sheet d3, MR350C-100S was used for a sheet d4, 805S-3 was used for a sheet d5, MR350C-100S was used for a sheet d6, 805S-3 was used for a sheet d7, MR350C-100S was used for a sheet d8, MR350C-100S was used for a sheet d9, 805S-3 was used for a sheet d10, MR350C-100S was used for a sheet d11, and TR350C-100S was used for a sheet d12. A total of the sheets d2 and d3 was set to be three plies. The other sheets were set to be one ply, respectively. A portion constituting an end of a partial sheet has the number of plies which is smaller than one. A weight of the shaft was 45 g. Fiber orientation angles of the sheets d1 to d12 are shown in FIG. 7. The specification and evaluation result of the shaft is shown in the following Table 5.

TABLE 5

Specification and Evaluation Result of Example 4

| | | Fourth Section | Third Section | Second Section | First Section |
|---|---|---|---|---|---|
| Number of Sheet End | Each Section | 1 | 1 | 4 | 2 |
| | Nx | | 4 | | |
| | Nn | | 1 | | |
| | Difference (Nx − Nn) | | 3 | | |
| Number of Sheet in Each Section | d1 | 0.0 | 0.0 | 0.0 | 0.7 |
| | d2 | 1.0 | 1.0 | 1.0 | 1.0 |
| | d3 | 1.0 | 1.0 | 1.0 | 1.0 |
| | d4 | 0.8 | 0.0 | 0.0 | 0.0 |
| | d5 | 1.0 | 0.3 | 0.0 | 0.0 |
| | d6 | 1.0 | 1.0 | 0.3 | 0.0 |
| | d7 | 1.0 | 1.0 | 0.7 | 0.0 |
| | d8 | 1.0 | 1.0 | 1.0 | 1.0 |
| | d9 | 0.0 | 0.0 | 0.5 | 1.0 |
| | d10 | 1.0 | 1.0 | 1.0 | 0.5 |
| | d11 | 1.0 | 1.0 | 1.0 | 1.0 |
| | d12 | 0.0 | 0.0 | 0.5 | 1.0 |
| | Total Number of Sheet | 8.8 | 7.3 | 7.0 | 7.2 |
| | Px | | 8.8 | | |
| | Pn | | 7.0 | | |
| | Ratio (Px/Pn) | | 1.26 | | |
| Durability Test Result (Index) | | | 253 | | |

Example 5

Figure 8:
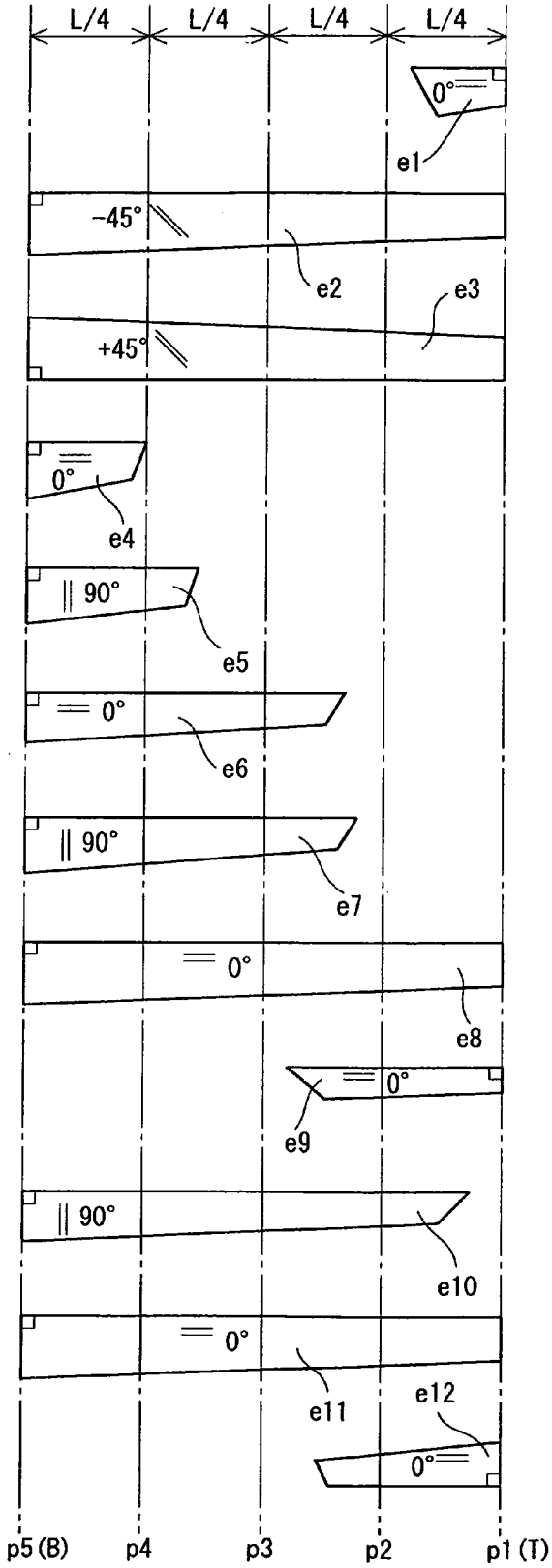
FIG. 8 is a developed view showing a shaft according to an example 5.

A shaft according to an example 5 was obtained in the same manner as in the example 1 except for the developed view of the shaft (the view showing a structure of a sheet) illustrated in FIG. 8. TR350C-100S was used for a sheet e1, HRX350C-075S was used for a sheet e2, HRX350C-075S was used for a sheet e3, MR350C-100S was used for a sheet e4, 805S-3 was used for a sheet e5, MR350C-100S was used for a sheet e6, 805S-3 was used for a sheet e7, MR350C-100S was used for a sheet e8, MR350C-100S was used for a sheet e9, 805S-3 was used for a sheet e10, MR350C-100S was used for a sheet e11, and TR350C-100S was used for a sheet e12. A total of the sheets e2 and e3 was set to be three plies. The other sheets were set to be one ply, respectively. A portion constituting an end of a partial sheet has the number of plies which is smaller than one. A weight of the shaft was 45 g. Fiber orientation angles of the sheets e1 to e12 are shown in FIG. 8. The specification and evaluation result of the shaft is shown in the following Table 6.

TABLE 6

Specification and Evaluation Result of Example 5

| | | Fourh Section | Third Section | Second Section | First Section |
|---|---|---|---|---|---|
| Number of Sheet End | Each Section | 1 | 1 | 4 | 2 |
| | Nx | | 4 | | |
| | Nn | | 1 | | |
| | Difference (Nx − Nn) | | 3 | | |
| Number of Sheet in Each Section | e1 | 0.0 | 0.0 | 0.0 | 0.7 |
| | e2 | 1.0 | 1.0 | 1.0 | 1.0 |
| | e3 | 1.0 | 1.0 | 1.0 | 1.0 |
| | e4 | 0.8 | 0.0 | 0.0 | 0.0 |
| | e5 | 1.0 | 0.3 | 0.0 | 0.0 |
| | e6 | 1.0 | 1.0 | 0.5 | 0.0 |
| | e7 | 1.0 | 1.0 | 0.7 | 0.0 |
| | e8 | 1.0 | 1.0 | 1.0 | 1.0 |
| | e9 | 0.0 | 0.0 | 0.5 | 1.0 |

TABLE 6-continued

| Specification and Evaluation Result of Example 5 | | | | |
|---|---|---|---|---|
| | Fourh Section | Third Section | Second Section | First Section |
| e10 | 1.0 | 1.0 | 1.0 | 0.5 |
| e11 | 1.0 | 1.0 | 1.0 | 1.0 |
| e12 | 0.0 | 0.0 | 0.5 | 1.0 |
| Total Number of Sheet | 8.8 | 7.3 | 7.2 | 7.2 |
| Px | 8.8 | | | |
| Pn | 7.2 | | | |
| Ratio (Px/Pn) | 1.22 | | | |
| Durability Test Result (Index) | 152 | | | |

Example 6

Figure 9:
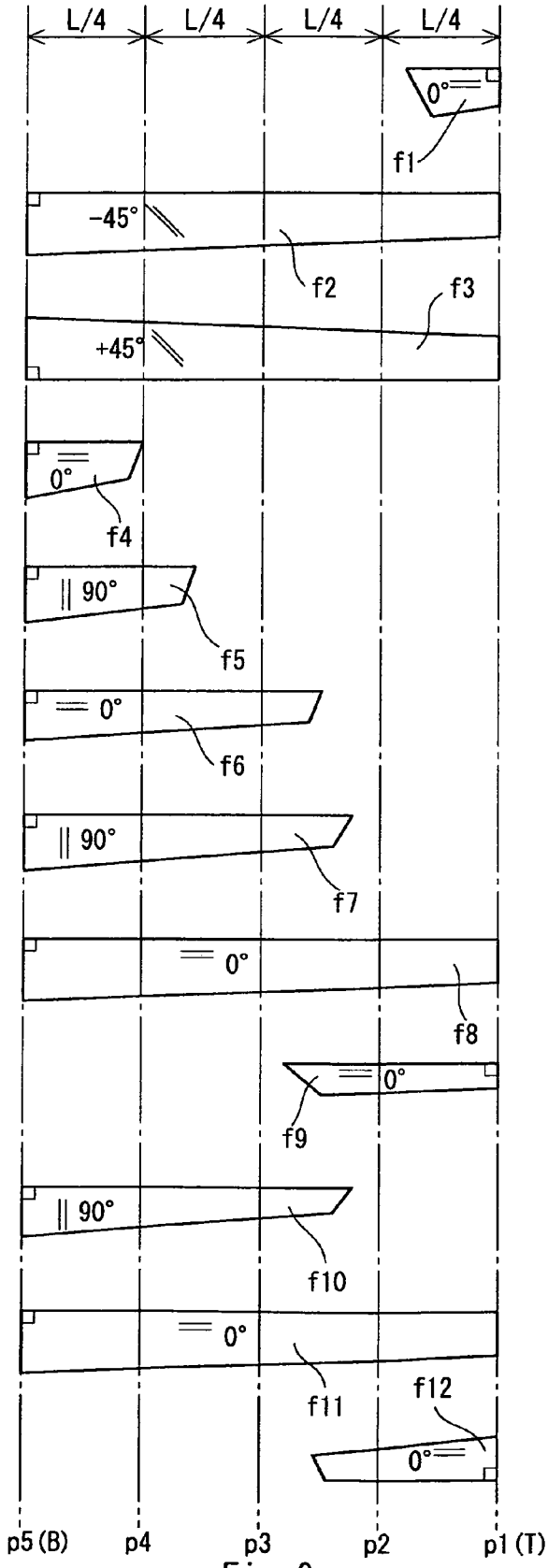
FIG. 9 is a developed view showing a shaft according to an example 6.

A shaft according to an example 6 was obtained in the same manner as in the example 1 except for the developed view of the shaft (the view showing a structure of a sheet) illustrated in FIG. 9. TR350C-100S was used for a sheet f1, HRX350C-075S was used for a sheet f2, HRX350C-075S was used for a sheet f3, MR350C-100S was used for a sheet f4, 805S-3 was used for a sheet f5, MR350C-100S was used for a sheet f6, 805S-3 was used for a sheet f7, MR350C-100S was used for a sheet f8, MR350C-100S was used for a sheet f9, 805S-3 was used for a sheet f10, MR350C-100S was used for a sheet f11, and TR350C-100S was used for a sheet f12. A total of the sheets f2 and f3 was set to be three plies. The other sheets were set to be one ply, respectively. A portion constituting an end of a partial sheet has the number of plies which is smaller than one. A weight of the shaft was 44 g. Fiber orientation angles of the sheets f1 to f12 are shown in FIG. 9. The specification and evaluation result of the shaft is shown in the following Table 7.

TABLE 7

| Specification and Evaluation Result of Example 6 | | | | | |
|---|---|---|---|---|---|
| | | Fourth Section | Third Section | Second Section | First Section |
| Number of Sheet End | Each Section | 1 | 1 | 5 | 1 |
| | Nx | 5 | | | |
| | Nn | 1 | | | |
| | Difference (Nx − Nn) | 4 | | | |
| Number of Sheet in Each Section | f1 | 0.0 | 0.0 | 0.0 | 0.7 |
| | f2 | 1.0 | 1.0 | 1.0 | 1.0 |
| | f3 | 1.0 | 1.0 | 1.0 | 1.0 |
| | f4 | 0.8 | 0.0 | 0.0 | 0.0 |
| | f5 | 1.0 | 0.3 | 0.0 | 0.0 |
| | f6 | 1.0 | 1.0 | 0.3 | 0.0 |
| | f7 | 1.0 | 1.0 | 0.7 | 0.0 |
| | f8 | 1.0 | 1.0 | 1.0 | 1.0 |
| | f9 | 0.0 | 0.0 | 0.5 | 1.0 |
| | f10 | 1.0 | 1.0 | 0.7 | 0.0 |
| | f11 | 1.0 | 1.0 | 1.0 | 1.0 |
| | f12 | 0.0 | 0.0 | 0.6 | 1.0 |
| | Total Number of Sheet | 8.8 | 7.3 | 6.8 | 6.7 |
| | Px | 8.8 | | | |
| | Pn | 6.7 | | | |
| | Ratio (Px/Pn) | 1.31 | | | |
| Durability Test Result (Index) | | 193 | | | |

Comparative Example 1

Figure 10:
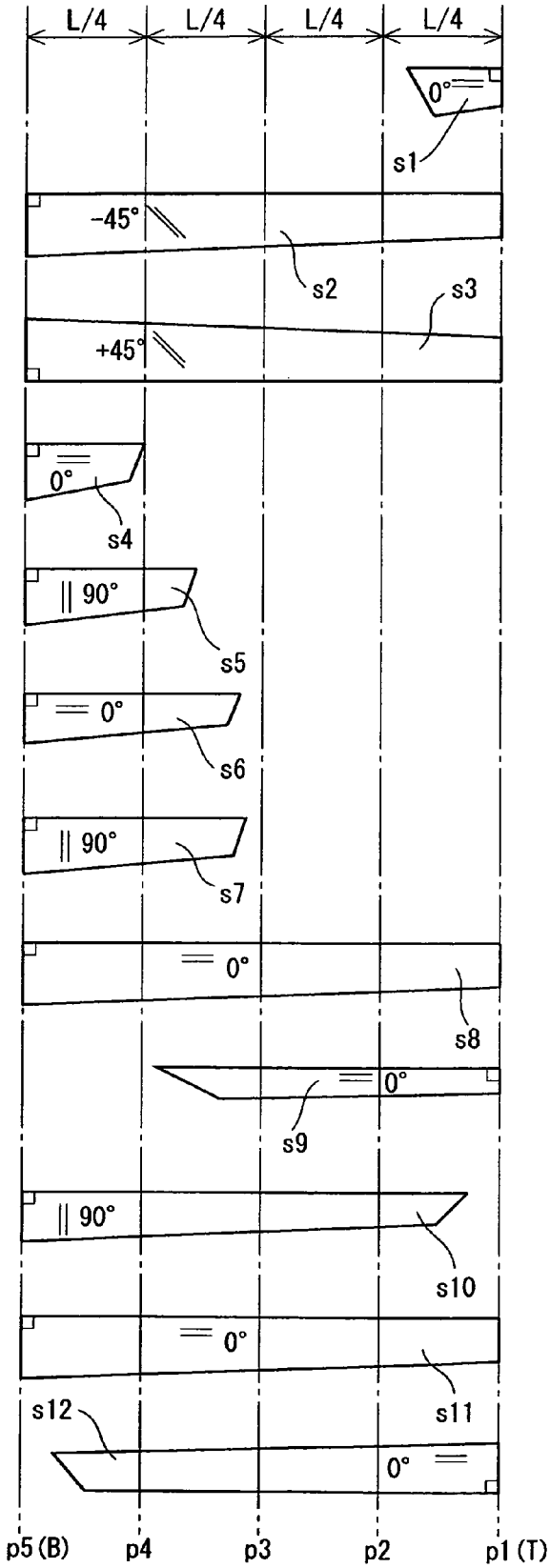
FIG. 10 is a developed view showing a shaft according to a comparative example 1.

A shaft according to a comparative example 1 was obtained in the same manner as in the example 1 except for the developed view of the shaft (the view showing a structure of a sheet) illustrated in FIG. 10. TR350C-100S was used for a sheet s1, HRX350C-075S was used for a sheet s2, HRX350C-075S was used for a sheet s3, MR350C-100S was used for a sheet s4, 805S-3 was used for a sheet s5, MR350C-100S was used for a sheet s6, 805S-3 was used for a sheet s7, MR350C-100S was used for a sheet s8, MR350C-100S was used for a sheet s9, 805S-3 was used for a sheet s10, MR350C-100S was used for a sheet s11, and TR350C-100S was used for a sheet s12. A total of the sheets s2 and s3 was set to be three plies. The other sheets were set to be one ply, respectively. A portion constituting an end of a partial sheet has the number of plies which is smaller than one. A weight of the shaft was 48 g. Fiber orientation angles of the sheets s1 to s12 are shown in FIG. 10. The specification and evaluation result of the shaft is shown in the following Table 8.

TABLE 8

| Specification and Evaluation Result of Comparative Example 1 | | | | | |
|---|---|---|---|---|---|
| | | Fourth Section | Third Section | Second Section | First Section |
| Number of Sheet End | Each Section | 2 | 4 | 0 | 2 |
| | Nx | 4 | | | |
| | Nn | 0 | | | |
| | Difference (Nx − Nn) | 4 | | | |
| Number of Sheet in Each Section | s1 | 0.0 | 0.0 | 0.0 | 0.7 |
| | s2 | 1.0 | 1.0 | 1.0 | 1.0 |
| | s3 | 1.0 | 1.0 | 1.0 | 1.0 |
| | s4 | 0.8 | 0.0 | 0.0 | 0.0 |
| | s5 | 1.0 | 0.3 | 0.0 | 0.0 |
| | s6 | 1.0 | 0.7 | 0.0 | 0.0 |
| | s7 | 1.0 | 0.8 | 0.0 | 0.0 |
| | s8 | 1.0 | 1.0 | 1.0 | 1.0 |
| | s9 | 0.0 | 0.5 | 1.0 | 1.0 |
| | s10 | 1.0 | 1.0 | 1.0 | 0.5 |
| | s11 | 1.0 | 1.0 | 1.0 | 1.0 |
| | s12 | 0.6 | 1.0 | 1.0 | 1.0 |
| | Total Number of Sheet | 9.4 | 8.3 | 7.0 | 7.2 |
| | Px | 9.4 | | | |
| | Pn | 7.0 | | | |
| | Ratio (Px/Pn) | 1.34 | | | |
| Durability Test Result (Index) | | 100 | | | |

A difference between the examples 1 and 2 includes a length of a sixth sheet from an inside of the shaft and a length of a twelfth sheet from the inside of the shaft. A difference between the examples 1 and 3 includes the length of the sixth sheet from the inside of the shaft, a length of a tenth sheet from the inside of the shaft, and the length of the twelfth sheet from the inside of the shaft. A difference between the examples 1 and 4 includes the length of the sixth sheet from the inside of the shaft and the length of the twelfth sheet from the inside of the shaft. A difference between the examples 1 and 5 includes the length of the sixth sheet from the inside of the shaft and the length of the twelfth sheet from the inside of the shaft. A difference between the examples 1 and 6 includes the length of the sixth sheet from the inside of the shaft, the length of the tenth sheet from the inside of the shaft, and the length of the twelfth sheet from the inside of the shaft. A difference between the example 1 and the comparative example 1 includes a length of a seventh sheet from the inside of the shaft and a length of a ninth sheet from the inside of the shaft.

In the example 2, particularly, the durability is lower than that in the example 1 because the difference (Nx−Nn) is two. In the example 3, particularly, the durability is slightly lower than that in the example 2 because the ratio (Px/Pn) is high. In the example 4, particularly, the durability is slightly lower than that in the example 2 because the difference (Nx−Nn) is three. In the example 5, the position in the longitudinal direction of the shaft of the end of the sheet e6 is coincident with that in the longitudinal direction of the shaft of the end of the sheet e9 and a stress concentration is apt to be generated in the same positions. For this reason, the durability in the example 5 is slightly lower than that in the example 4. In the example 6, the durability is slightly lower than that in the example 4 because the difference (Nx−Nn) is four.

As shown in the Tables 2 to 8, each of the examples has a higher evaluation than that in the comparative example. In the comparative example 1, particularly, the durability is deteriorated because N2 is zero. From the result of the evaluation, the advantages of the present invention are apparent.

The present invention can be applied to all golf club shafts, for example, a shaft for a wood type golf club, a shaft for an iron type golf club and a shaft for a patter.

The above description is only illustrative and various changes can be made without departing from the scope of the present invention.

What is claimed is:

1. A golf club shaft obtained by winding and curing a prepreg sheet including a matrix resin and a fiber, wherein the sheet includes a full length sheet including a tip end and a butt end, provided wholly in a longitudinal direction of the shaft and a partial sheet provided partially in the longitudinal direction of the shaft, the number of the full length sheets is equal to or greater than two, the number of the partial sheets is equal to or greater than seven, and when four sections obtained by dividing the shaft into four equal parts in the longitudinal direction are set to be first, second, third and fourth sections from a tip end side in order, the total number of end(s) of the partial sheets positioned in the first section is represented as N1, the total number of end(s) of the partial sheets positioned in the second section is represented as N2, the total number of end(s) of the partial sheets positioned in the third section is represented as N3, and the total number of end(s) of the-partial sheets positioned in the fourth section is represented as N4, all of N1, N2, N3 and N4 are equal to or greater than one, wherein an end of a partial sheet is a side of the partial sheet falling inside of each of the four sections, wherein when a side of the partial sheet is positioned on the tip end or positioned on the butt end, the side of the partial sheet is not regarded to be the end of the partial sheet, wherein if the partial sheet is triangular, then the partial sheet is regarded to have no end, and wherein the position of the end of the partial sheet is determined by a middle point of the end.

2. The golf club shaft according to claim 1, wherein when a maximum value of N1, N2, N3 and N4 is represented as Nx and a minimum value of N1, N2, N3 and N4 is represented as Nn, a difference (Nx−Nn) is equal to or smaller than four.

3. The golf club shaft according to claim 1, wherein the partial sheet is constituted by a UD (unidirection) prepreg sheet or a hoop layer.

4. A golf club shaft obtained by winding and curing a prepreg sheet including a matrix resin and a fiber, wherein the sheet includes a full length sheet including a tip end and a butt end, provided wholly in a longitudinal direction of the shaft and a partial sheet provided partially in the longitudinal direction of the shaft, the number of the full length sheets is equal to or greater than two, the number of the partial sheets is equal to or greater than four, and when four sections obtained by dividing the shaft into four equal parts in the longitudinal direction are set to be first, second, third and fourth sections from a tip end side in order, the total number of end(s) of the partial sheets positioned in the first section is represented as N1, the total number of end(s) of the partial sheets positioned in the second section is represented as N2, the total number of end(s) of the partial sheets positioned in the third section is represented as N3, and the total number of end(s) of the-partial sheets positioned in the fourth section is represented as N4, all of N1, N2, N3 and N4 are equal to or greater than one, wherein an end of a partial sheet is a side of the partial sheet falling inside of each of the four sections, wherein when a side of the partial sheet is positioned on the tip end or positioned on the butt end, the side of the partial sheet is not regarded to be the end of the partial sheet, and wherein if the partial sheet is triangular, then the partial sheet is regarded to have no end, wherein when the total number of the sheets belonging to the first section is represented as P1, the total number of the sheets belonging to the second section is represented as P2, the total number of the sheets belonging to the third section is represented as P3, the total number of the sheets belonging to the fourth section is represented as P4, a maximum value of P1, P2, P3 and P4 is represented as Px, and a minimum value of P1, P2, P3 and P4 is represented as Pn, a ratio (Px/Pn) is equal to or lower than 1.5, wherein a number of one sheet belonging to each section that is used to count the total number of the sheets belonging to the each section, P1, P2, P3 and P4 respectively, is a proportion of a length of the portion of the sheet within each section to an entire length of each section.

5. The golf club shaft according to claim 4, wherein a ratio (Px/Pn) is equal to or lower than 1.4.

6. The golf club shaft according to claim 4, wherein a ratio (Px/Pn) is equal to or lower than 1.35.

7. A golf club comprising a head, a grip and a golf club shaft, wherein the golf club shaft is obtained by winding and curing a prepreg sheet including a matrix resin and a fiber, the sheet includes a full length sheet including a tip end and a butt end, provided wholly in a longitudinal direction of the shaft and a partial sheet provided partially in the longitudinal direction of the shaft, the number of the full length sheets is equal to or greater than two, the number of the partial sheets is equal to or greater than seven, and when four sections obtained by dividing the shaft into four equal parts in the longitudinal direction are set to be first, second, third and fourth sections from a tip end side in order, the total number of end(s) of the partial sheets positioned in the first section is represented as N1, the total number of end(s) of the partial sheets positioned in the second section is represented as N2, the total number of end(s) of the partial sheets positioned in the third section is represented as N3, and the total number of end(s) of the partial sheets positioned in the fourth section is represented as N4, all of N1, N2, N3 and N4 are equal to or greater than one, wherein an end of a partial sheet is a side of the partial sheet falling inside of each of the four sections, wherein when a side of the partial sheet is positioned on the tip end or positioned on the butt end, the side of the partial sheet is not regarded to be the end of the partial sheet, wherein if the partial sheet is triangular, then the partial sheet is regarded to have no end, and wherein the position of the end of the partial sheet is determined by a middle point of the end.

8. The golf club shaft according to claim 7, wherein the partial sheet is constituted by a UD (unidirection) prepreg sheet or a hoop layer.

* * * * *